US005081007A

United States Patent [19]

Sakuma

[11] Patent Number: 5,081,007

[45] Date of Patent: * Jan. 14, 1992

[54] METHOD FOR PROCESSING A SILVER HALIDE LIGHT-SENSITIVE PHOTOGRAPHIC MATERIAL AND AN AUTOMATIC PROCESSOR THEREFOR

[75] Inventor: Haruhiko Sakuma, Hachioji, Japan

[73] Assignee: Konica Corporation, Tokyo, Japan

[ * ] Notice: The portion of the term of this patent subsequent to Jul. 10, 2007 has been disclaimed.

[21] Appl. No.: 244,374

[22] Filed: Sep. 14, 1988

[30] Foreign Application Priority Data

Sep. 15, 1987 [JP] Japan ..... 62-230563

[51] Int. Cl.[5] ..... G03C 5/26

[52] U.S. Cl. ..... 430/434; 430/502; 430/963; 430/966

[58] Field of Search ..... 430/434, 502, 963, 966

[56] References Cited

U.S. PATENT DOCUMENTS 4,861,702 8/1989 Suzuki et al. ..... 430/564
4,897,340 1/1990 Ohtani et al. ..... 430/403

OTHER PUBLICATIONS

AGFA-Gevaert, Rapiline 95 No. 215748, Jul. 1985.
AGFA-Gevaert, Scopix 12, No. MR/681/3215, Jun. 1981.
AGFA-Gevaert, Curix 60, No. 215149, Aug. 1987.
AGFA-Gevaert, Curix 402, No. 215138, Apr. 1987.

*Primary Examiner*—Richard L. Schilling
*Assistant Examiner*—Janet C. Baxter
*Attorney, Agent, or Firm*—Finnegan, Henderson, Farabow, Garrett and Dunner

[57] ABSTRACT

A method for processing a silver halide light-sensitive photographic material by a super rapid process and an automatic processing machine used therefor is disclosed. The method comprises a step of processing an imagewise exposed silver halide light-sensitive photogrpahic material comprising a support and a photographic component layer provided on at least one side of said support, under conditions satisfying the equation given below:

$$50 \leqq l^{0.75} \times T \leqq 124$$

wherein l is the length of a path along which said silver halide light-sensitive photographic material to be conveyed for processing, the length being more than 0.7 m and less than 3.1 m, T is time, expressed in terms of seconds, necessary for said silver halide light-sensitive photographic material to pass through said path.

8 Claims, 2 Drawing Sheets

$\ell = 2.74$ [m]

METHOD FOR PROCESSING A SILVER HALIDE LIGHT-SENSITIVE PHOTOGRAPHIC MATERIAL AND AN AUTOMATIC PROCESSOR THEREFOR

FIELD OF THE INVENTION

The present invention relates to a method for processing a silver halide light-sensitive photographic material which is capable of rapid processing, obtaining high-speed and high-quality images, and also relates to an automatic processor used for the method.

The present invention provides a method of processing a silver halide light-sensitive photographic material by a super-rapid process which has never existed before and which can obtain high-sensitivity and yet high-quality images, and an automatic developing machine which is capable of attaining this super-rapid process even with a compact size.

BACKGROUND OF THE INVENTION

In the field of photographic light-sensitive materials there is a growing demand for increasing still further photographic speed.

Referring to, for example, radiographic light-sensitive materials, as the number of medical X-ray examinations has increased in recent years, a reduction in the exposure dose has been strongly demanded in medical circles, and by general international opinion. In order to meet this demand, state-of-the-art photographic technology enabling the formation of an adequately high-quality radiographic image even with a small exposure dose is essential, and for this reason, the development of photographic techniques with enhanced precision, which obtain a high-definition image with only a slight exposure dose, i.e., development of photographic techniques for an even higher photographic speed, have been required.

If a proper sensitization technique is applied, photographic speed of a silver halide can be further be increased while maintaining the grain size being kept intact. i.e., with covering power being unchanged. In this regard, many proposals have until now been reported which include, for example, a method of incorporating a development accelerator, such as a thioether, into an emulsion: in the case of spectrally sensitizing a silver halide emulsion, a method of supersensitizing the silver halide emulsion by using appropriately combined sensitizing dyes: improving techniques for spectrally sensitizing dyes: and the like. These methods, however, are hard to be considered always widely applicable to high-speed silver halide light-sensitive photographic materials: high-speed silver halide emulsions, because of being as chemically sensitized as is possible, are liable to be fogged during their preservation, if the above methods are used.

Furthermore, in the field of medical radiography, orthochromatic light-sensitive materials sensitive to the wavelength range of from 540 to 550 nm, which have been achieved by orthochromatic sensitization of conventional regular-type light-sensitive materials sensitive to the wavelength region of 450 nm, or those panchromatic or infra-red sensitive photographic materials, which are sensitive to spectral region of 630 nm to 830 nm like photosensitive materials for laser printer, have come into use. The light-sensitive material thus sensitized becomes so wide in the wavelength region range to which it is sensitive, and the sensitivity is so high that the exposure dose can be reduced, lessening the affect on the human body. Thus, the sensitization by sensitizing dyes is a very effective sensitization means, but has problems yet to be solved: for example, the problem that sufficient sensitivity cannot be obtained, depending on the type of photographic emulsion used.

On the other hand, the quantity of silver halide photographic materials processed by every photo-finisher has been increasing year by year, resulting in a demand for a still greater increase in the speed of processing: i.e., increasing the number of photographic sheets processed within a predetermined period of time.

The above tendency can also be seen in the field of radiographic light-sensitive materials such as, for example, medical X-ray films. With the rapid increase in the incidence of medical diagnoses, due to the strict enforcement of regular physical examinations, checkup items have been increased in order to make the diagnosis even more accurate, thus resulting in the increase in the number occasion for the radiographic images to be taken.

It is of course advantageous for automatic processing apparatus to speed up the processing of X-ray films, because whilst should the processors operate at the same capacity, its compact size contributes to space-saving.

However, although the merits of rapid processing are great, as mentioned above, there are a lot of problems yet to be solved: (a) insufficient densities (decrease in the speed, contrast and the maximum density), (b) insufficient fixation, (c) insufficient washing of film, and (d) insufficient drying of film, and the like, of which insufficient fixation and insufficient washing of film lead to discoloration of the film during the preservation period of the developed films; thus causing deterioration in the quality of the processed film.

It has been known in the art that decreasing the thickness of layers which constitute the photographic material, i.e., 'photographic component layer', and hardening the photographic constituting layer to a certain extent make it possible to process a light sensitive silver halide photographic material at a high speed. It has also been possible to produce a light sensitive photographic material suitable for rapid processing by reducing of the total amount of silver to be used.

Thus, reducing the thickness, increasing the hardness of the film, or reducing the amount of silver used can enhance adaptability of the photographic material to rapid processing, however, image quality still remains to be a problem. That is, it is not too much to say that only images with extremely deteriorated image qualities have been obtainable, and that it has been impossible to design a system suitable for practical use.

Particularly, most important of all, when a photographic material thus constituted is processed by super rapid process, it has usually been the case that only images with extremely deteriorated graininess can been obtained. For example, referring to adaptability of this technique to X-ray photography for medical use, deteriorated graininess, for example, can cause difficulty in diagnostic judging of a focus, which makes it almost impossible to apply this technique to practical use.

In recent light-sensitive materials, such as radiographic films, prepared by coating a light-sensitive silver halide emulsion on both sides of a support base for the purpose of image quality improvement, there is a tendency that increased amount of sensitizing dyes or other dyes for higher image definition and higher photographic speed are used. As a result, the problem, that considerable amount of dye remains inside the processed light-sensitive material, the so-called dye-stain trouble, which had not been a matter of concern in the in the conventional processing systems, has become increasingly likely to occur, a large drawback to super-rapid processing.

SUMMARY OF THE INVENTION

It is an object of the present invention to provide a novel method of processing a silver halide light-sensitive photographic material, by which, the above-mentioned problems of the prior art can greatly be eased, i.e.. a method which is capable of forming a photographic images with high-sensitivity, high-quality image and excellent graininess by a super-rapid process.

Another object of the present invention is to provide an automatic processor suitably used for the method of the present invention.

That is, the present invention relates to a method for processing a silver halide light-sensitive photographic material which comprises a step of processing an image-wise exposed silver halide light-sensitive photographic material comprising a support and a photographic component layer provided on at least one side of said support, under conditions satisfying the equation given below:

$$50 \leqq l^{0.75} \times T \leqq 124$$

wherein l is the length of a path along which said silver halide light-sensitive photographic material to be conveyed for processing, the length being more than 0.7 m and less than 3.1 m, T is time, expressed in terms of seconds, necessary for said silver halide light-sensitive photographic material to pass through said path.

The present invention also relates to a method for processing a silver halide light-sensitive photographic material which comprises a step of processing an image-wise exposed silver halide light-sensitive photographic material comprising a support and a photographic component layer provided on at least one side of said support, under conditions satisfying the equation given below:

$$50 \leqq l^{0.75} \times T \leqq 124$$

wherein l is the length of a path along which said silver halide light-sensitive photographic material to be conveyed for processing, the length being more than 0.7 m and less than 3.1 m, T is time, expressed in terms of seconds, necessary for said silver halide light-sensitive photographic material to pass through said path.

provided that said photographic component layer being provided on at least one side of the support contains a hydrophilic colloid at an amount of 2.0 g to 3.8 g in terms of the coated amount per unit square meter, that said photographic component layer includes at least one silver halide light-sensitive emulsion layer, the total amount of silver halide contained in said at least one silver halide light-sensitive emulsion layer being less than 3.5 g in terms of the coated amount of equivalent silver per unit square meter, and that said photographic component layer has a melting point in water of not less than 86° C.

The present invention further relates to an automatic processing apparatus for developing a silver halide light-sensitive photographic material comprising a transport means for conveying a silver halide light-sensitive photographic material along a path, said path including an inlet through which a silver halide light-sensitive photographic material is fed for processing, including development, and an outlet through which a processed photographic material is discharged, and length (l) between the inlet and the outlet along said path is not less than 0.7 m and not more than 3.1 m, a container for storing a processing liquid provided between said inlet and said outlet along said path, and a driving means for propelling said transport means, said driving means and said transport means being so arranged as to satisfy the following equation;

$$50 \leqq l^{0.75} \times T \leqq 124$$

wherein T is time, expressed in terms of seconds, necessary for said silver halide light-sensitive photographic material to pass through said path.

DETAILED DESCRIPTION OF THE INVENTION

Figure 1:
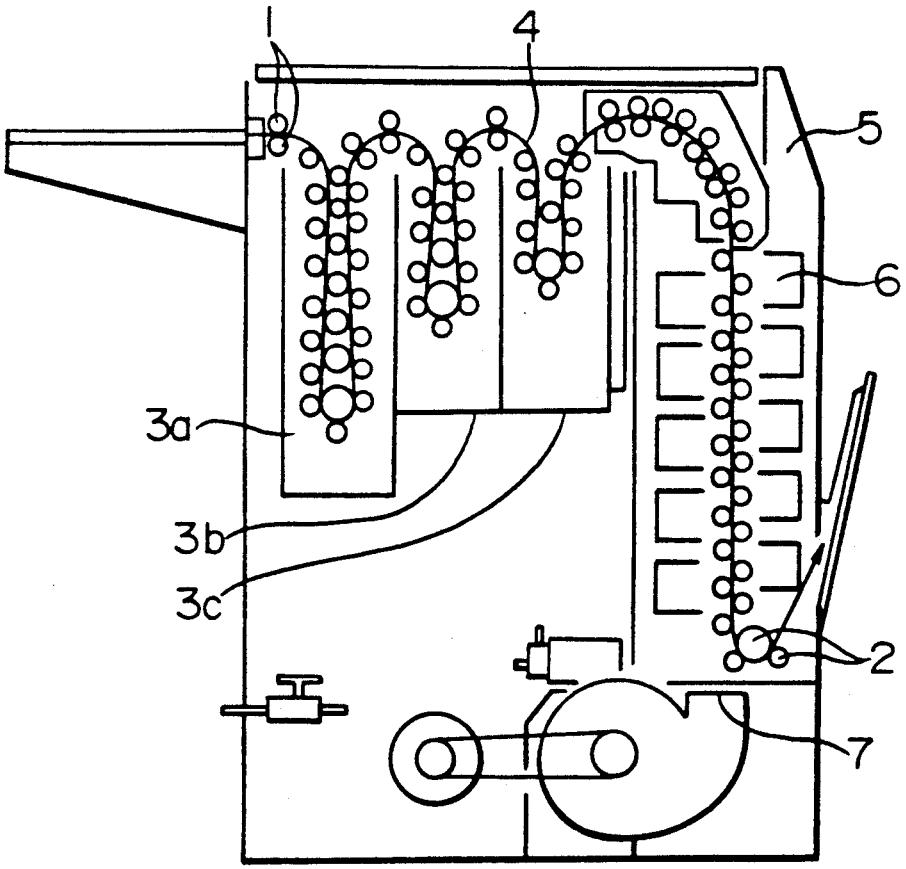
FIG. 1 and FIG. 2 are drawings showing the constructions of automatic processors that are used in the example of this invention.

The above length of the path (l) can easily be obtained by passing a roll film, for example, a light-sensitive material having photographic component layers on a 175 μm-thick polyethylene terephthalate support such as roll Konica X-ray Film Type-A (manufactured by Konica Corporation), through an automatic processing apparatus.

The above T is the whole period of time required for the film to travel for processing, including the period while the film passes through a crossover section between processing baths, i.e., starting from the point where its leading edge is inserted between the juxtaposed cores of the first pair of rollers at the inlet of the automatic processor, advancing through the developing bath, crossover section, fixing bath, crossover section, washing bath, crossover section and drying section until the point where its leading edge comes out of the final rollers at the outlet of the drying section. In other words, T may be said to be a quotient (sec.) obtained by dividing the whole length (in meters) of the path (l) by the line transport speed (m/sec.)].

The reason why the crossover section passing time is included in T is, as well-known in the art, that the solution in the preceding process is considered to be infiltrating into and swelling the gelatin layer, and thereby have the layer's processing makes substantial progress even in the crossover section.

The present invention is originally based on the discovery that when a silver halide light-sensitive photographic material, satisfying the above-mentioned features, is processed under the conditions as mentioned above, images with high image quality are unexpectedly found to be obtainable. This fact was unexpected because in accordance with the teaching of the prior art, although images could have been obtainable by rapid processing, it has been considered that they are not applicable to practical use because of deteriorated image quality, especially in view of inferior graininess. However, it was found by the present inventors that by setting forth 1 and T in accordance with the above-mentioned conditions, images with high image qualities having improved graininess even under rapid processing conditions could unexpectedly be obtainable.

As mentioned above, the fact that it is possible to obtain an image with high image quality even under rapid processing conditions in accordance with the specific conditions of the present invention, has not been known in the art.

It has also been found by the inventors that the above-mentioned processing conditions are applicable not only for the rapid processing of a specific kind of silver halide light-sensitive photographic material but also for various kinds of other silver halide light-sensitive photographic materials. Further, it was found that the conditions of the present invention are easily applicable to an automatic processing apparatus.

The present invention is hereinafter further explained in detail.

The silver halide light-sensitive photographic material used in the present invention, which is hereinafter referred to as 'the photographic material of the invention', is, as mentioned hereinabove, has basically no limitation in its composition or structure. However, according to one of the most preferable embodiments of the invention, the present invention is advantageously applicable to a silver halide light-sensitive photographic material having the total amount of hydrophilic colloid, preferably a gelatin, contained in the photographic component layers on the same side of a light-sensitive silver halide emulsion layer, of not less than 2.0 g/m$^2$ and not more than 3.8 g/m$^2$. When the total amount of the hydrophilic colloid exceeds 3.8 g/m$^2$, the processed film shows a satisfactory graininess, but tends to be lowered in the maximum density as well as in the photographic speed, while if less than 2.0 g/m$^2$, the film is prone to show conspicuous drying marks or the processed silver image becomes yellowish. Further, the total coating amount of silver halide on the side of the silver halide emulsion layer is less than 3.5 g/m$^2$ in terms of the amount of equivalent silver. If the coating weight of silver halide exceeds 3.5 g/m$^2$, fixability of the photographic material becomes lowered.

The light-sensitive silver halide grains, which are preferably used in the present invention, are those silver halide grains in which the average grain size in terms of the diameter of a circle equivalent in the area to the projected grain image is from 0.2 to 1.6 μm, and those having the silver iodide content of from 0.1 to 4.0 mole and the silver bromide content of not less than 96 mole % are preferred from the standpoint of the developability and sensitivity.

The melting point of the silver halide light-sensitive photographic material of this invention in water is preferably not less than 86° C. If it is less than 86° C. the film layer's strength in a processing solution becomes weakened, causing its hydrophilic colloid to adhere to the transport roller of the automatic processing machine, which tends to deteriorate the film transporting performance of the roller. The term 'melting point' herein means a value obtained by measuring a film layer in pure water having a resistivity of not less than $1\times10^6\Omega$cm.

The silver halide light-sensitive photographic material of this invention is one whose melting point can be raised to not less than 86° C. by using a gelatin hardener. If not hardened, the melting point is usually about 29° to 32° C.

Silver halide grains and additives that are advantageously applicable to the light-sensitive material of this invention will now be described.

Silver halide grains to be used in this invention, although no restrictions are put on their configuration, structure, etc., are desirable to be such grains as described in Japanese Patent Application Nos. 53651/1986 and 6890/1987 (from the second line at p.24 to the fifth line at p.42) or such planar grains as disclosed in Japanese Patent Publication Open to Public Inspection (hereinafter referred to as Japanese Patent O.P.I. Publication) Nos. 113927/1983, 113928/1983, 105636/1984 and 147727/1985.

Preferable average grain size of the silver halide grains to be used for the photographic material of the invention is, generally speaking, within the range not less than 0.2 μm but not more than 2.0 μm. In the case of grains of cubic or spherical shape, the preferable average grain size is 0.2 μm to 1.0 μm, and in the case of tabular having the aspect ratio of not less than 5, 0.2 μm to 2.0 μm is preferable. In the case of the tabular shaped grains, the grain is preferably a silver iodobromide containing 0.1 to 3.5 mol % of silver iodide. Herein, the average grain size (γ) is defined as the average diameter of the circles when the projected images of silver halide grains are converted into circles having equivalent areas. To be more specific, the average grain size (γ) is given in the following equation, where $n_i$ is number of grains and $r_i$ is the diameters of respective grains:

$$\gamma = \frac{\Sigma n_i r_i}{\Sigma n_i}$$

For the emulsion and the structure of the silver halide grain to be used in this invention, those techniques as disclosed in Japanese Patent Application Nos. 286896/1985 and 11427/1986, and Japanese Patent O.P.I. Publication Nos. 136738/1985, 147727/1985, 254032/1985, 215540/1985, 232445/1986, 3247/1987, 7040/1987, 54249/1987, 123446/62, 123447/1987, 124550/1987, 124551/1987, 124552/1987 and 151840/1987 may suitably be used.

As processing chemicals and other techniques relating to the processing, those techniques as described in Japanese Patent O.P.I. Publication Nos. 52848/1985, 136741/1985 and 36744/1986, and Mason 'Photographic Processing Chemistry.' published by Focal Press, may be useful.

To the photographic light-sensitive material to be used in this invention is desirable to be added a sensitizing dye during its manufacturing process of from the silver halide grain formation up to the emulsion coating. The using amount of the sensitizing dye is preferably not less than 3 mg/m$^2$, and more preferably from 5 to 30 mg/m$^2$ with respect to the coating amount on one side of the support.

As the sensitizing dye and chemical sensitization method, those as described in Japanese Patent O.P.I. Publication No. 80237/1986 may be suitable.

For additives and methods of adding them, reference can be made to Japanese Patent Application Nos. 53651/1986 and 6890/1987 (from 18th line at p.77 to 9th line at p.117). As processing chemicals it is desirable to use those chemicals as disclosed in from 10th line at p.117 to 12th line at p.123 of the same publication. And as other additives, those as described in Research Disclosure No. 176, 22-31 (RD 17643, 1978) may be useful.

The light-sensitive material to be used in this invention is allowed to contain arbitrary additives, which are described in Research Disclosure. Vol.176, No.17643 (Dec. 1978) and Vol. 187, No.18716 (Nov. 1976). Pages in these publications describing relevant contents to them are collectively listed in the following table.

Photographic additives of the prior art usable in preparing the emulsion for a light-sensitive material to which the invention is applied are also described in the abovementioned two Research Disclosure publications, and also listed in the same table.

| Additives | RD17643 | RD18716 |
|---|---|---|
| 1 Chemical sensitizers | p. 23 | Right col. p. 648 |
| 2 Sensitivity increasing agents | | " |
| 3 Spectral sensitizers, Supersensitizers | p. 22-24 | Right col. p. 648 to right col. p. 649 |
| 4 Brightening agents | p. 24 | |
| 5 Antifoggants and stabilizers | p. 24-25 | Right col. p. 649 |
| 6 Color-forming couplers | p. 25 | Right col. p. 649 |
| 7 Organic solvents | p. 25 | |
| 8 Light-absorbing agents, filter dyes, ultraviolet absorbing agents | p. 25-26 | Right col. p. 648 to left col. p. 650 |
| 9 Antistain agents | Right col. p. 25 | Left col. to right col. p. 650 |
| 10 Dye image stabilizers | p. 25 | |
| 11 Hardening agents | p. 26 | Left col. p. 651 |
| 12 Binder materials | p. 26 | " |
| 13 Plasticizers, lubricants | p. 27 | Right col. p. 650 |
| 14 Coating aids, surface active agents | p. 26-27 | " |
| 15 Antistatic agents | p. 27 | " |

The various processing conditions of the processing method of the present invention are hereinafter explained:

The processing length (l) of the path of the roller transport-type automatic processor of this invention is in the range of 0.7 to 3.1, which will provide satisfactory results. If the l is less than 0.7, then each processing line becomes shorter, leading to the reduction in the number of rollers to be used, deterioration of the photographic speed or worsening of the transportability, while if the l is more than 3.1, then the transport speed increases to excess, not only tending to cause scratches on film but drastically deteriorating the durability of the automatic processor.

In the present invention the product of the $l^{0.75}$ and T is not less than 50, but not more than 124, if the product of the $l^{0.75}$ and T is less than 50, not only does the sensitivity of film abruptly fall but, in the case of a film using a sensitizing dye in an amount of not less than 10 mg/m$^2$ per side of its support, the dye remains inside the film, which comes into serious question. This problem was not clear until we have found in our investigation. The product of the $l^{0.75}$ and T is preferably not less than 76.

On the other hand, if the product of the $l^{0.75}$ and T exceeds 124, despite the sensitivity showing almost no increase, the graininess of the resulting photographic image becomes largely deteriorated with increasing fog.

In contrast thereto, by using the processing method according to the present invention, it becomes possible to obtain such various favorable results as images with high sensitivity and with improved graininess can be obtained, hardly with such problems as insufficient fixing, washing or drying.

Next, the automatic processing(developing) apparatus of the present invention is explained. The automatic processing apparatus of the invention is one in which the above mentioned conditions can be attained therein. Preferably, the processing apparatus of the present invention employs a roller transport system for conveying a the photographic material of the invention.

The total number of all transport rollers in the automatic processor of this invention is desirable to be determined so that the value obtained by dividing the whole processing length l of the path of the processor by the number of the rollers is in the range of from 0.01 to 0.04. And percentages of the respective sections' processing periods of time are as follows:

| | |
|---|---|
| Insertion + development + crossover | 25 to 40% |
| Fixation + crossover | 12 to 25% |
| Wash + crossover | 10 to 25% |
| Squeeze + dry | 25 to 45% |
| Total | 100% |

The rollers to be used for conveying the film should preferably measure 12 to 60 mm in diameter and 30 to 110 cm in length, and may be made of any various materials, such as bakelite-types (which may contain glass powder, metal powder, plastic powder, etc.) and rubber-types (e.g., neoprene, isoprene, silicone rubber). For those rollers in the crossover and squeegee sections, water-repellent elastic silicone rubber or a highly water-absorbent synthetic leather product called 'Kurarino' (produced by Kuraray Co., Ltd.) may be preferably used.

The transport rollers, in order to improve its traction, may have a rough surfaced, with a depth in the range of from 0.05 to 1.0 mm.

In the drying section, in order to lighten the drying load, the water content of the film is desirably be lessened to 20 g/m$^2$ by the time the film arrives at the squeegee rack. For this purpose, the use of, for example, the foregoing water-repellent roller or highly water-absorbent roller, is very effective. Alternatively, a design whereby part of the drying wind is sent as far as the squeegee roller section is also effective.

In the drying section, in order to increase the heat transfer coefficient, so that the film is well dried even in rapid processing, the distance between the drying wind outlet and film is desirably in the range of from 1 to 10 mm. The temperature of the drying wind should be in the range of preferably from 35° to 55° C., and simultaneously drying by an infrared heater or microwave may also be used in combination.

Furthermore, the automatic processor of this invention, when used in the foregoing method of this invention for processing a silver halide light-sensitive photographic material according to this invention, can exhibit excellent results.

EXAMPLE

The present invention will now be illustrated by the following example, but the invention is not limited thereto.

EXAMPLE 1

By using silver iodide monodisperse grains as nuclei, containing 2.0 mol % silver iodide having an average grain size of 0.2 μm, silver iodobromide containing 30 mole % silver iodide was grown at pH 9.1 and pAg 7.7, and then, under the conditions of pH 8.0 and pAg 9.1, to this were added equimolar amounts of potassium bromide and silver nitrate, whereby three monodisperse emulsions having average grain sizes of 1.02 μm, 0.62 μm and 0.46 μm, respectively, each containing silver iodobromide grains with an average silver iodide content of 2.1 moles, were prepared. Each emulsion had its excessive salts desalted therefrom by the normal aggregation method: that is, to the emulsion kept at 40° C. was added an aqueous solution of formalin condensate with sodium naphthalenesulfonate and magnesium sulfate to thereby make an aggregation. After removing the supernatant, to the aggregation was added pure water at a temperature of up to 40° C., and again an aqueous magnesium sulfate solution was added to repeat aggregation, and then the supernatant was removed. To these grains were added ammonium thiocyanate in an amount of $1.9\times10^{-3}$ mole per mole of silver, appropriate amounts of chloroauric acid and hypo, and 800 mg per mole of silver halide of a mixture of the following spectral sensitizing dyes A and B in a ratio by weight of 25:1 to thereby perform its chemical ripening, and 15 minutes before the completion of the chemical ripening, potassium iodide was added in an amount of 200 mg per mole of silver to the grains, which were then stabilized by $3\times10^{-2}$ mole of 4-hydroxy-6-methyl-1,3,3*a*,7-tetrazaindene, and the thus treated three emulsions were mixed in a ratio of 20%, 50% and 30% in order from larger to smaller grain sizes, respectively, and then the hereinafter-mentioned additives and lime-treated gelatin were added to the mixed emulsion, whereby an emulsion was prepared, which was regarded as Coating Liquid (1).

Thirty grams of gelatin, 10.5 g of potassium bromide and 10 ml of an aqueous 0.5% by weight thioether [$HO(CH_2)_3S(CH_2)_2S(CH_2)_2S(CH_2)_2OH$] solution were added to and dissolved into i liter of water, and into this solution (pAg=9.1, pH=6.5) kept at 65° C., with stirring, were added simultaneously for a period of 15 seconds, 30 ml of an aqueous 0.88 mole silver nitrate solution and 30 ml of an aqueous 0.88 mole potassium iodide and potassium bromide mixture (in a molar ratio of 97:3) solution, and after that, to this were added simultaneously for a period of about 70 minutes, 600 ml of an aqueous 1 mole silver nitrate solution and 600 ml of an aqueous 1 mole potassium bromide and potassium iodide mixture (in a molar ratio of 97:3) solution, whereby a planar silver iodobromide crystal grain emulsion was prepared. The obtained planar silver halide grains have an average grain diameter of 1.18 μm and a thickness of 0.11 μm, and their silver iodide content is 3.0 mole %. This emulsion was desalted by a precipitation method, and then chemically sensitized by a gold-sulfur sensitization method, and after that, spectrally sensitized by adding thereto a sensitizing dye, sodium 3-[5-chloro-2-(2-[5-chloro-3-(3-sulfonate-propyl)-benzoxazolino-2-indene-methyl]-1-butene)-3-benzoxazolinopropane sulfonate in an amount of 150 mg per mole of silver halide, and further, as in the previous case, 4-hydroxy-6-methyl-1,3,3*a*,7-tetrazaindene was added.

These grains were subjected to an optimum chemical sensitization in the same manner as previously mentioned, and to this were added the same stabilizer, additives and lime-treated gelatin, whereby an emulsion was prepared, which was regarded as Emulsion Coating Liquid (2).

Further, to the coating liquid, in addition to the hereinafter described additives, were added the following Compounds (1) and (2) in the following respective amounts per mole of silver halide.

(1)

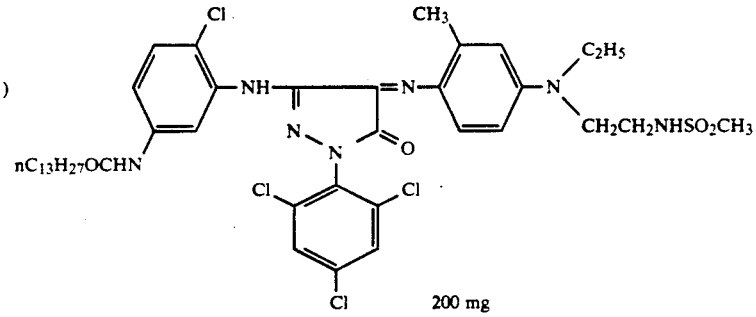

200 mg (2) Tricresyl phosphate 0.6 g

Compound (1), in accordance with the method described in (3) of Example 1 of Japanese Patent O.P.I. Publication No. 285445/1986, was dissolved into an oil comprised of Compound (2), then the solution was dispersed into a hydrophilic colloid solution, and the dispersed liquid was added to the emulsion so that these compounds in the above amounts were contained in the emulsion coating liquid.

As for the protective layer, a coating liquid having the hereinafter described composition was prepared.

In addition, the coating was made so that the coating weight of silver halide was 1.7 g/m² in silver equivalent per side of the support, and that of its hydrophilic colloid was 2.0 g/m² in the emulsion layer, and that of gelatin in the protective layer was 1.0 g/m², coated on both sides simultaneously by means of two slide-hopper-type coaters at a speed of 60 meters per minute on a 175 μm-thick polyethylene terephthalate film base subbed with a subbing liquid comprised of an aqueous copolymer-dispersed liquid, prepared by diluting a copolymer so as to be in a 10% by weight concentration, the copolymer being comprised of three different monomers: 50% by glycidyl methacrylate, 10% by weight methyl methacrylate and 40% by weight butyl methacrylate, and the coated layers were then dried in 2 minutes and 20 seconds, whereby a sample was obtained.

The obtained sample was placed in between leaves of a fluorescent screen (X-ray intensifying screen) KO-250 (available from Konishiroku Photo Industry Co.. Ltd.), and then exposed through a Penetrometer B-type aluminum step wedge (available from Konishiroku Medical Co., Ltd.) for 0.05 of a second to X rays from an X-ray source with a tube voltage of 130 kvp at 20 mA, and the processed in the following developer and fixer solutions for varied periods of time by means of the prototype automatic processor shown in FIG. 1 or FIG. 2, whereby Samples 1 to 26 were prepared.

Figure 2:
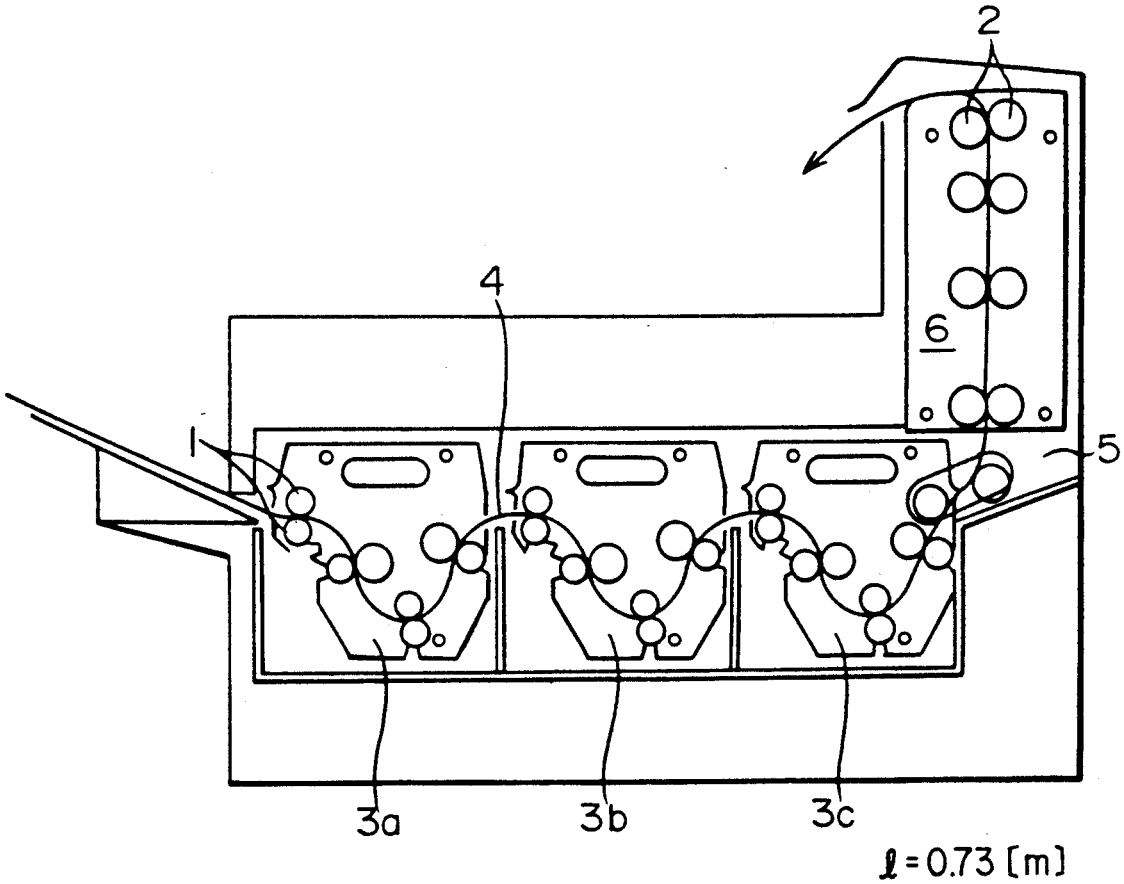

In FIG. 1 and FIG. 2, 1 is a first pair of rollers at the light-sensitive material insertion opening, 2 is a final pair of rollers at the outlet of the drying section, *3a* is a developing bath, *3b* is a fixing bath, *3c* is a washing bath, 4 is a light-sensitive material to be processed, 5 is a squeegee section, 6 is a drying section and 7 is an outlet for the drying air.

The spectrally sensitizing dyes that were used in preparing the above samples are as follows:

Spectrally Sensitizing Dye A

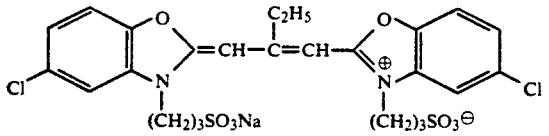

Spectrally Sensitizing Dye B

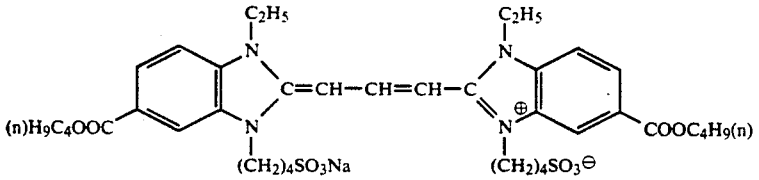

The additives that were used in preparing the silver halide emulsion coating liquid are as follows: Each amount added is shown in an amount per mole of silver halide.

| | |
|---|---|
| 1,1-Dimethylol-1-bromo-1-nitromethane | 70 mg |
| 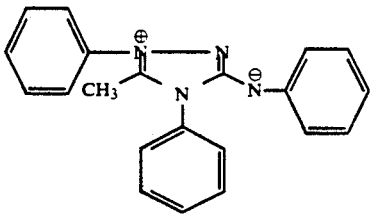 | 150 mg |
| t-Butyl-catechol | 400 mg |
| Polyvinyl pyrrolidone (molecular weight 1000) | 1.0 g |
| Styrene-maleic anhydride copolymer | 2.5 g |
| Trimethylol propane | 10 g |
| Diethylene glycol | 5 g |
| Nitrophenyl-triphenyl-phosphonium chloride | 50 mg |
| Ammonium 1,3-hydroxybenzene-4-sulfonate | 4 g |
| Sodium 2-mercaptobenzimidazol-5-sulfonate | 1.5 mg |
| 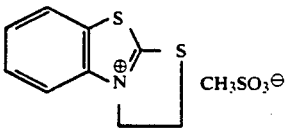 | 70 mg |

-continued

| | |
|---|---|
| $n\text{-}C_4H_9OCH_2CH(OH)CH_2N(CH_2COOH)_2$ | 1 g |

The additives that were used in preparing the protective layer coating liquid are as follows: Each amount added is shown in an amount per liter of the coating liquid.

| | |
|---|---|
| Lime-treated inert gelatin | 68 g |
| Acid-treated gelatin | 2 g |
| $NaO_3S-CH(CH_2COOC_{10}H_{21})-COOC_5H_{11}$ (coating aid) | 1 g |
| Trimethyl methacrylate, matting agent, having an average area particle, size of 3.5 μm | 1.1 g |
| Silicon dioxide particles, matting agent, having an average area particle size of 1.2 μm | 0.5 g |
| Ludox AM (colloidal silica) (product of DuPont) | 30 g |
| Aqueous 2% sodium 2,4-dichloro-6-hydroxy-1,3,5-triazine solution (hardening agent) | 10 ml |
| 35% formalin (hardening agent) | 2 ml |
| Aqueous 40% glyoxal solution (hardening agent) | 1.5 ml |
| 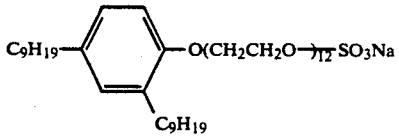 | 1.0 g |
| 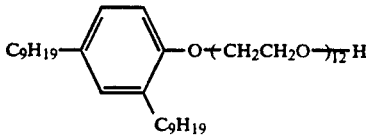 | 0.4 g |
| $CH_2COO(CH_2)_9CH_3$ / $CHCOO(CH_2)_2CH(CH_3)_2$ / $SO_3Na$ | 0.3 g |

-continued

| | |
|---|---|
| 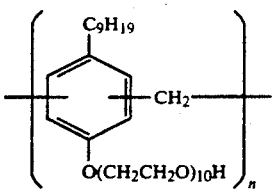 | 2.5 g |
| (mixture, n is an integer of 2–5) | |
| $NaO_3S-CH(CH_2COOCH_2(C_2F_4)_3H)-COOCH_2(C_2F_4)_3H$ | 0.5 g |
| $F_{19}C_9-O-(CH_2CH_2O)_{10}-CH_2CH_2-OH$ | 3 mg |
| $C_4F_9SO_3K$ | 2 mg |

The melting points of the samples thus prepared in water were all 93° C. Evaluation of each of the samples was made after processing by the prototype automatic processors shown in FIGS. 1 and 2, which have been designed so that their processing speed is variable. The developing took plate at 35° C. and the fixing at 33° C.

The compositions of developer and fixer solutions that were used are as follows:

| <Developer Solution> | |
|---|---|
| Potassium sulfite | 70 g |
| Trisodium hydroxyethylethylenediaminetriacetate | 8 g |
| 1,4-Dihydroxybenzene | 28 g |
| Boric acid | 10 g |
| 5-Methylbenzotriazole | 0.04 g |
| 1-Phenyl-5-mercaptotetrazole | 0.01 g |
| Sodium metabisulfite | 5 g |
| Acetic acid (90%) | 13 g |
| Triethylene glycol | 15 g |
| 1-Phenyl-3-pyrazolidone | 1.2 g |
| S-Nitroindazole | 0.2 g |
| 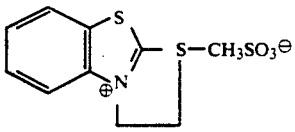 | 0.001 g |

-continued

| | |
|---|---|
| Glutaraldehyde | 4.0 g |
| Disodium ethylenediaminetetraacetate | 2.0 g |
| Potassium bromide | 4.0 g |
| 5-Nitrobenzimidazole | 1.0 g |
| Add water to make 1 liter. | |
| Potassium hydroxide is used to adjust the pH to 10.50. | |
| <Fixer Solution> | |
| Sodium thiosulfate, pentahydrated | 45 g |
| Disodium ethylenediaminetetraacetate | 0.5 g |
| Ammonium thiosulfate | 150 g |
| Anhydrous sodium sulfite | 8 g |
| Potassium acetate | 16 g |
| Aluminum sulfate, deca-octadecahydrated | 27 g |
| Sulfuric acid (50% by weight) | 6 g |
| Citric acid | 1 g |
| Boric acid | 7 g |
| Glacial acetic acid | 5 g |

Add water to make 1 liter. Glacial acetic acid is used to adjust the pH to 4.0.

Washing water was supplied at a temperature of 18° C. at a rate of 1.5 liters per minute to the automatic processor.

Each processed sample was measured with respect to its sensitivity and graininess.

In Table 1, the sensitivity of each sample is shown in a relative speed to the speed of Sample 1, the reciprocal of the X-ray dose to give the blackened density of fog+1.0, regarded as 100.

Evaluation of the graininess of each sample was made in the following manner: Each sample was exposed to a JIS B light source so as to have a blackened density of 1.0, and the graininess obtained after processing was visually evaluated.

| Evaluation criteria | |
|---|---|
| Excellent | A |
| Good | B |
| Coarseness slightly conspicuous | C |
| Coarseness considerably conspicuous | D |
| Too coarse for practical use | E |

The evaluated results are given in table 1.

TABLE 1

| Sample No. | Processor used | Total processing time (sec) | $1^{0.75} \times T$ (millisecond) | Em coating liq. used | Relative speed | Fog | Graininess | Remarks |
|---|---|---|---|---|---|---|---|---|
| 1 | FIG. 1 | 20 | 42.6 | (1) | 100 | 0.02 | A | Comp. |
| 2 | FIG. 1 | 25 | 53.2 | (1) | 119 | 0.02 | A | Inv. |
| 3 | FIG. 1 | 35 | 74.5 | (1) | 121 | 0.02 | A | Inv. |
| 4 | FIG. 1 | 49 | 104.4 | (1) | 123 | 0.03 | A | Inv. |
| 5 | FIG. 1 | 56 | 119.3 | (1) | 124 | 0.03 | B | Inv. |
| 6 | FIG. 1 | 60 | 127.8 | (1) | 125 | 0.05 | D | Comp. |
| 7 | FIG. 1 | 70 | 149.1 | (1) | 126 | 0.08 | E | Comp. |
| 8 | FIG. 1 | 20 | 42.6 | (2) | 99 | 0.03 | A | Comp. |
| 9 | FIG. 1 | 22 | 46.9 | (2) | 103 | 0.03 | A | Comp. |
| 10 | FIG. 1 | 40 | 85.2 | (2) | 120 | 0.03 | A | Inv. |
| 11 | FIG. 1 | 48 | 102.2 | (2) | 121 | 0.04 | A | Inv. |
| 12 | FIG. 1 | 58 | 123.5 | (2) | 123 | 0.04 | B | Inv. |
| 13 | FIG. 1 | 66 | 140.6 | (2) | 126 | 0.07 | E | Comp. |
| 14 | FIG. 2 | 55 | 43.4 | (1) | 80 | 0.03 | A | Comp. |
| 15 | FIG. 2 | 60 | 47.4 | (1) | 91 | 0.03 | A | Comp. |
| 16 | FIG. 2 | 80 | 63.2 | (1) | 114 | 0.03 | A | Inv. |
| 17 | FIG. 2 | 120 | 94.8 | (1) | 116 | 0.03 | B | Inv. |
| 18 | FIG. 2 | 150 | 118.5 | (1) | 118 | 0.04 | B | Inv. |
| 19 | FIG. 2 | 160 | 126.4 | (1) | 119 | 0.06 | D | Comp. |
| 20 | FIG. 2 | 180 | 142.2 | (1) | 120 | 0.09 | E | Comp. |
| 21 | FIG. 2 | 60 | 47.4 | (2) | 91 | 0.03 | A | Comp. |
| 22 | FIG. 2 | 75 | 59.2 | (2) | 112 | 0.03 | A | Inv. |
| 23 | FIG. 2 | 100 | 79.0 | (2) | 115 | 0.03 | A | Inv. |
| 24 | FIG. 2 | 135 | 106.6 | (2) | 116 | 0.04 | B | Inv. |
| 25 | FIG. 2 | 155 | 122.4 | (2) | 118 | 0.04 | B | Inv. |

TABLE 1-continued

| Sample No. | Processor used | Total processing time (sec) | $l^{0.75} \times T$ (millisecond) | Em coating liq. used | Relative speed | Fog | Graininess | Remarks |
|---|---|---|---|---|---|---|---|---|
| 26 | FIG. 2 | 175 | 138.2 | (2) | 119 | 0.07 | E | Comp. |

Note:
'Inv.': invention sample
'Comp.': comparative sample

As is apparent from Table 1, samples satisfactory in the fog and graininess as well as in the sensitivity can be obtained where their processing time is adjusted so that the $l^{0.75} \times T$ becomes equal to between 76 and 124.

What is claimed is:

1. A method for processing a silver halide light-sensitive photographic material which comprises a step of processing an imagewise exposed silver halide light-sensitive photographic material comprising a support and a photographic component layer provided on at least one side of said support, under conditions satisfying the equation given below:

$$50 \leqq l^{0.75} \times T \leqq 124$$

wherein l is the length of a path along which said silver halide light-sensitive photographic material is conveyed for processing, said path having a partial length along which said silver halide light-sensitive photographic material is conveyed through an inlet for processing, a developing bath, and a crossover between said developing bath and a fixing bath, the length being more than 0.7 m and less than 3.1 m, said partial length is from 25 to 40% of said path, T is time, expressed in terms of seconds, necessary for said silver halide light-sensitive photographic material to pass through said path, provided that said photographic component layer being provided on at least one side of the support contains a hydrophilic colloid at an amount of 2.0 g to 3.8 g in terms of the coated amount per unit square meter, that said photographic component layer includes at least one silver halide light-sensitive emulsion layer, the total amount of silver halide contained in said at least one silver halide light-sensitive emulsion layer being less than 3.5 g in terms of the coated amount of equivalent silver per unit square meter, and that said photographic component layer has a melting point in water of not less than 86° C.

2. The method of claim 1, wherein the photographic component layer is provided on both sides of the support.

3. The method of claim 1, wherein said support is a transparent support.

4. The method of claim 1, wherein the hydrophilic colloid is a gelatin.

5. A method for processing a silver halide light-sensitive photographic material which comprises a step of processing an imagewise exposed silver halide light-sensitive photographic material comprising a support and a photographic component layer provided on at least one side of said support, under conditions satisfying equation given below:

$$50 \leqq l^{0.75} \times T \leqq 124$$

wherein l is the length of a path along which said silver halide light-sensitive photographic material is conveyed for processing, said path having a partial length along which said silver halide light-sensitive photographic material is conveyed through an inlet for processing, a developing bath, and a crossover between said developing bath and a fixing baths, the length being more than 0.7 m and less than 3.1 m, said partial length is from 25 to 40% of said path, T is time, expressed in terms of seconds, necessary for said silver halide light-sensitive photographic material to pass through said path.

6. The method of claim 5, wherein the photographic component layer is provided on both sides of the support.

7. The method of claim 5, wherein said support is a transparent support.

8. The method of claim 5, wherein the hydrophilic colloid is a gelatin.

* * * * *

UNITED STATES PATENT AND TRADEMARK OFFICE

CERTIFICATE OF CORRECTION

PATENT NO. : 5,081,007

DATED : January 14, 1992

INVENTOR(S) : Haruhiko Sakuma

It is certified that error appears in the above-identified patent and that said Letters Patent is hereby corrected as shown below:

Claim 5, column 16, line 24, after "satisfying" insert --the--.

Claim 5, column 16, line 35, change "baths" to --bath--.

ON THE TITLE PAGE

Abstract, line 2, change "super rapid" to --superrapid--.

Abstract, line 5-6, change "photogrpahic" to --photographic--.

After Inventor's name, change "Hachioji" to --Tokyo--.

Signed and Sealed this

Twenty-ninth Day of June, 1993

Attest:

Michael K. Kirk

MICHAEL K. KIRK

Attesting Officer

Acting Commissioner of Patents and Trademarks